US010449601B2

(12) United States Patent
Cogneras et al.

(10) Patent No.: US 10,449,601 B2
(45) Date of Patent: Oct. 22, 2019

(54) SHELL MOLD FOR A SECTOR OF A 360°-SET OF GUIDE VANES

(71) Applicant: Safran Aircraft Engines, Paris (FR)

(72) Inventors: Thierry Eric Cogneras, Montmorency (FR); Nicolas Romain Benjamin Leriche, Asnieres sur Seine (FR); Anthony Dominique Désiré Scattolini, Claye Souilly (FR); Joseph Toussaint Tami Lizuzu, Gonesse (FR)

(73) Assignee: Safran Aircraft Engines, Paris (FR)

( * ) Notice: Subject to any disclaimer, the term of this patent is extended or adjusted under 35 U.S.C. 154(b) by 70 days.

(21) Appl. No.: 15/852,035

(22) Filed: Dec. 22, 2017

(65) Prior Publication Data

US 2018/0178274 A1 Jun. 28, 2018

(30) Foreign Application Priority Data

Dec. 26, 2016 (FR) ..... 16 63383

(51) Int. Cl.

| | |
|---|---|
| ***B22C 9/04*** | (2006.01) |
| ***B22C 9/24*** | (2006.01) |
| ***B22C 7/02*** | (2006.01) |
| ***B22D 25/02*** | (2006.01) |
| ***F01D 5/00*** | (2006.01) |
| ***F01D 9/04*** | (2006.01) |

(52) U.S. Cl.

CPC ..... *B22C 9/24* (2013.01); *B22C 7/02* (2013.01); *B22C 9/04* (2013.01); *B22D 25/02* (2013.01); *F01D 5/00* (2013.01); *F01D 9/044* (2013.01); *F05D 2230/211* (2013.01)

(58) Field of Classification Search

CPC .... B22C 7/02; B22C 9/04; B22C 9/24; B22D 25/02

USPC ..... 164/361, 23, 34, 44, 45, 122.1

See application file for complete search history.

(56) References Cited

U.S. PATENT DOCUMENTS

2015/0027653 A1* 1/2015 Guerche et al. ..... B22C 9/04 164/47

FOREIGN PATENT DOCUMENTS

| | | | |
|---|---|---|---|
| CN | 104308082 | B | 5/2016 |
| EP | 2092999 | A1 | 8/2009 |
| FR | 2724857 | A1 | 3/1996 |

(Continued)

OTHER PUBLICATIONS

Preliminary Search Report dated Oct. 16, 2017, in French priority application FR 1663383 (2 pages).

*Primary Examiner* — Kevin P Kerns

(74) *Attorney, Agent, or Firm* — Bookoff McAndrews, PLLC

(57) ABSTRACT

A shell mold for a guide vane sector includes a first platform and a second platform that are mutually coaxial and between which there extends at least one airfoil. The shell mold has a first platform molding portion suitable for forming the first platform, a second platform molding portion suitable for forming the second platform, an airfoil molding portion suitable for forming the airfoil, a fastener molding portion suitable for forming a fastener projecting from the first platform towards a first edge of the first platform, a main casting duct, a distribution duct connecting the main casting duct to the fastener molding portion, and an auxiliary duct connecting the main casting duct to the first platform molding portion beside said first edge.

9 Claims, 2 Drawing Sheets

(56) References Cited

FOREIGN PATENT DOCUMENTS

FR 2985924 A1 7/2013

* cited by examiner

SHELL MOLD FOR A SECTOR OF A 360°-SET OF GUIDE VANES

CROSS-REFERENCE TO RELATED APPLICATION(S)

This application claims the benefit of priority to French Patent Application No. 1663383, filed on Dec. 26, 2016, the entirety of which is incorporated by reference herein.

TECHNICAL FIELD

The present disclosure relates to fabricating 360°-sets of guide vanes, and more particularly it relates to a shell mold for a sector of a 360°-set of guide vanes. Such a mold can be used in the context of a lost-pattern or "investment" type casting method.

TECHNOLOGICAL BACKGROUND

In known manner, a turbine engine includes a combustion chamber in which air and fuel are mixed together prior to being burnt therein. The gas resulting from this combustion flows downstream from the combustion chamber and subsequently feeds a high pressure turbine and a low pressure turbine. Each turbine comprises one or more sets of stationary vanes, known as nozzles, alternating with one or more sets of moving blades, known as rotor wheels, with the blades being spaced apart circumferentially all around the rotor of the turbine.

Given the constraints, and in particular the temperature constraints that they need to withstand, nozzles are generally made by casting. In order to facilitate fabrication, a 360°-set of guide vanes such as a nozzle is subdivided into a plurality of angular sectors, each of which is cast separately in a shell mold.

Conventionally, a guide vane sector, also referred to below more simply as a "sector", comprises a first platform and a second platform that are coaxial about a common axis and that have extending between them at least one airfoil, and that also have a fastener projecting from the first platform towards a first edge of the first platform.

Nevertheless, it has been observed that after metal has been cast into a shell mold of the kind usually used for this type of sector, metallurgical defects can occur in the sector such as shrinkage, i.e. material shrinking as a result of late cooling of pockets of liquid metal. There therefore exists a need for a novel type of shell mold that makes it possible to limit, or even avoid, the appearance of metallurgical defects in the guide vane sector.

GENERAL SUMMARY

To this end, the present disclosure provides a shell mold for a guide vane sector comprising a first platform and a second platform that are mutually coaxial and between which there extends at least one airfoil, and a fastener projecting from the first platform towards a first edge of the first platform, the shell mold having a first platform molding portion suitable for forming the first platform, a second platform molding portion suitable for forming the second platform, an airfoil molding portion suitable for forming the airfoil, a fastener molding portion suitable for forming the fastener, a main casting duct, a distribution duct connecting the main casting duct to the fastener molding portion, and an auxiliary duct connecting the main casting duct to the first platform molding portion beside said edge.

A shell mold is a mold that is to be destroyed after casting the part, the sector in this example. This type of mold is frequently used in lost-pattern type casting methods, also known under the simplified term "lost-wax casting".

It can be understood that the first and second platforms are mutually coaxial about the axis of the guide vane set as a whole.

The above-mentioned mold portions define in negative manner the various portions of the guide vane sector, so that said sector portions can be obtained by casting a material into the corresponding mold portions. Thus, apart from the casting ducts needed to deliver the material, the inside shapes of the mold portions correspond to the outside shapes desired for the sector portions.

Below, for reasons of simplification and without loss of generality, mention is made of casting metal, nevertheless, the cast material could be any other compatible type of material. In addition, the term "metal" is used broadly herein to include metal alloys.

The main casting duct is a duct into which the molten metal can be cast. The molten metal can reach the main casting duct via other casting ducts, via a pouring cup or some other way.

The distribution duct connects the main casting duct to the fastener mold portion without passing via the first platform. Likewise, the auxiliary duct connects the main casting duct to the first platform mold portion without passing via the fastener. The distribution duct and the auxiliary duct are distinct.

When a plurality of fasteners project from the first platform towards an edge thereof, a plurality of distribution ducts may be provided, each connecting the main casting duct to a corresponding fastener mold portion. It can then be understood that the auxiliary duct is made up in addition of these distribution ducts. For reasons of concision, but without losing generality, only one fastener and only one distribution duct are described in detail below.

The distribution duct and the auxiliary duct thus provide two casting gates beside said edge of the first platform, whereby the flow of metal is better controlled and metallurgical defects are no longer formed in the first platform. In particular, the auxiliary duct enables metallostatic pressure to be delivered so as to ensure that the first platform is well filled, including in any fine portions of the first platform. Thus, the shrinkages observed with prior art shell molds can be eliminated because of the regularity with which the mold is filled, as is made possible by the presence of the distribution duct and of the auxiliary duct, or else the shrinkages can be offset into the material that solidifies in one of these ducts and that is eliminated when finishing the sector.

In some embodiments, the fastener projects from a side of the first platform that is opposite from its side connected to the airfoil. In these embodiments, the first and second platforms define an air flow passage for guiding a flow of air or the equivalent. The fact that the fastener projects from the side of the first platform that is opposite from the side connected to the airfoil ensures that the fastener does not disturb the flow of air.

In some embodiments, the fastener is thicker than the first platform, at least on the side of the first edge. As mentioned above, the first platform has a role that is essentially aerodynamic in that it contributes to defining a flow passage, whereas the fastener has a role that is essentially mechanical, enabling the sector to be rigidly assembled to another component, such as another guide vane stage. Thus, making provision for the fastener to be thicker than the first platform, at least locally, enables the weight of the sector to be optimized.

In some embodiments, the auxiliary duct is, at least for the most part, separated from the distribution duct by a distance that is not less than twice as great, preferably not less than three times as great, as the thickness of a wall of the auxiliary duct. This minimum distance serves firstly to guarantee uniform drying of the shell mold while it is being fabricated, as described in detail below, and secondly to avoid any hot point in the shell mold that might result from insufficiently removing heat from the metal. The term "for the most part" should be understood to mean that the auxiliary duct is preferably separated as much as possible from the distribution duct by said distance; nevertheless, there are certain points where the minimum distance between the distribution duct and the auxiliary duct cannot be achieved, e.g. where the auxiliary duct and the distribution duct are connected together or are connected to another duct at points that are close together.

In some embodiments, the auxiliary duct includes a connection bend for connection to the main casting duct, the connection bend projecting from the main casting duct in a direction substantially opposite to the casting direction. The casting direction is defined intrinsically by the shell mold as a function of the shape of said shell mold. The casting direction in question is preferably the downstream casting direction at the point where the connection bend is connected.

Because the connection bend projects from the main casting duct in a direction substantially opposite to the casting direction, metal does not penetrate into the auxiliary duct until those portions that are situated in the casting direction relative to said bend have become filled with metal. The connection bend as configured in this way serves to sequence the casting in the various ducts, e.g. causing the distribution duct to fill before the auxiliary duct. Consequently, the flow of metal forming the first platform is under even better control, thereby improving the structural integrity of the first platform, and more generally of the sector.

In some embodiments, the auxiliary duct includes at least one undulation. An undulation can thus designate a point of inflection in the auxiliary duct. Such an undulation serves to avoid the metal flowing too fast during casting. Laminar flow is thus maintained, thereby enhancing regular casting in the first platform. In addition, by limiting its speed, the metal is also prevented from tearing particles from the shell mold, which would otherwise affect the purity of the metal and the strength of the sector.

In some embodiments, the auxiliary duct is generally in the shape of a question mark. A question mark, i.e. the sign "?", comprises in particular a top bend that may act as a connection bend as defined above, followed by a central undulation. Alternatively, the auxiliary duct may be generally in the shape of the letter S or of the digit 2.

In some embodiments, the auxiliary duct portions that extend in different directions are connected together by a curved portion. Thus, sharp angles are avoided, thereby guaranteeing regular and turbulence-free flow of the metal. In addition, that avoids fluid impacts and particles being torn from the shell mold.

In some embodiments, the shell mold includes a casting chamber at the intersection between the main casting duct, the distribution duct, and the auxiliary duct, the casting chamber being larger than the main casting duct. The casting chamber defines a volume that becomes filled with a weight, i.e. a mass of excess metal lying outside the sector and serving to exert pressure on the metal situated within the sector, so as to ensure that the shell mold is filled completely. Alternatively, the casting chamber could be provided at the intersection between the main casting duct and the auxiliary duct, at the intersection between the main casting duct and the distribution duct, or indeed at the intersection between the distribution duct and the auxiliary duct.

In some embodiments, the auxiliary duct includes an enlarged portion at its junction with the first platform mold portion. This enlarged portion maintains the laminar nature of the flow and enables the flow to be distributed better in the first platform mold portion.

Alternatively, or in addition, the auxiliary duct includes, at its junction with the first platform mold portion, a portion that is situated in alignment with the first platform mold portion. This likewise serves to obtain better control over the flow of metal.

The present disclosure also provides a method of fabricating a shell mold, the method comprising providing a guide vane sector pattern comprising a first platform and a second platform that are mutually coaxial and between which there extends at least one airfoil, and a fastener projecting from the first platform towards a first edge of the first platform, the pattern further comprising a main casting duct pattern, a distribution duct pattern connecting the main casting duct pattern to the fastener, and an auxiliary duct pattern connecting the main casting duct pattern to the first platform beside said edge, the method further comprising making a shell around said pattern and optionally destroying the pattern.

The pattern is a temporary pattern that is to be destroyed. By way of example, it may be a pattern made of wax or the equivalent. It can be understood that the pattern, also referred to as a global pattern, comprises firstly a pattern of the part that is to form the platforms, the airfoil, and the fastener, and secondly the duct patterns. The duct patterns are likewise made of wax or the like, and they provide spaces around which the ducts are formed. Once the shell has been made, the duct patterns are subsequently destroyed together with the part pattern, so as to leave hollow ducts where they used to be.

The part pattern itself may be made around a core of refractory material, e.g. so as to form cooling channels inside the airfoil. The cores of refractory material withstand the destruction of the pattern and thereby form inserts in the shell mold that is fabricated in this way.

The present disclosure also provides a method of fabricating a guide vane sector, comprising providing a shell mold as described above and casting metal into the shell mold. The method may include other steps such as optionally directed cooling of the cast metal, destruction of the shell mold and of any refractory cores, etc.

BRIEF DESCRIPTION OF THE DRAWINGS

The invention and its advantages can be better understood on reading the following detailed description of embodiments given as non-limiting examples. The description refers to the accompanying drawings, in which.

DETAILED DESCRIPTION

Casting methods known as "lost-wax" or "lost-pattern" methods have themselves been known since antiquity. They are particularly adapted to producing metal parts of complex shape. Lost-pattern casting is used in particular for producing turbine engine airfoils or guide vane sectors. In lost-pattern casting, the first step is normally to fabricate a shell mold, which generally comprises making a pattern out of a material having a melting temperature that is comparatively low, e.g. out of a wax or a resin, with a refractory material shell then being made around the pattern. After the pattern has been destroyed, usually by discharging the material of the pattern from the inside of the shell mold, thereby explaining the name for these methods, a molten metal is cast into the mold, so as to fill the cavity left in the mold after the pattern has been discharged therefrom. Once the metal has cooled and solidified, the mold can be opened or destroyed in order to recover a metal part having the shape of the pattern.

Figure 1:
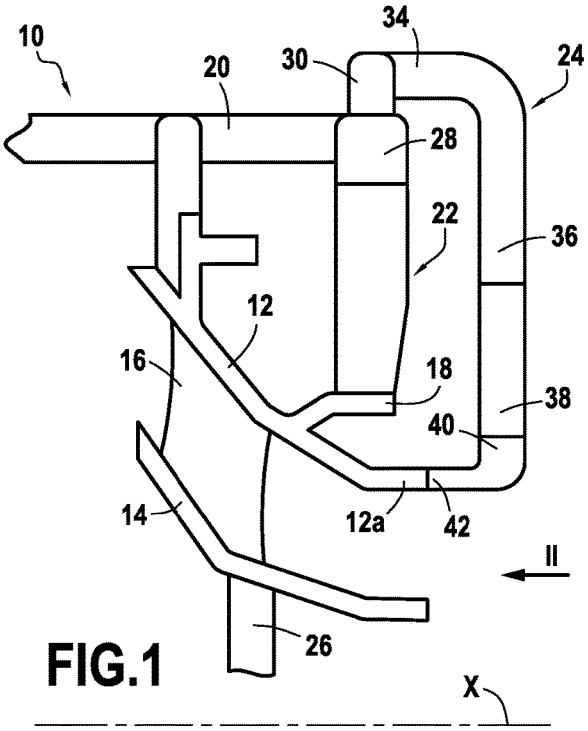
FIG. 1 is a diagrammatic side view in section of a guide vane sector pattern in an embodiment.
Figure 2:
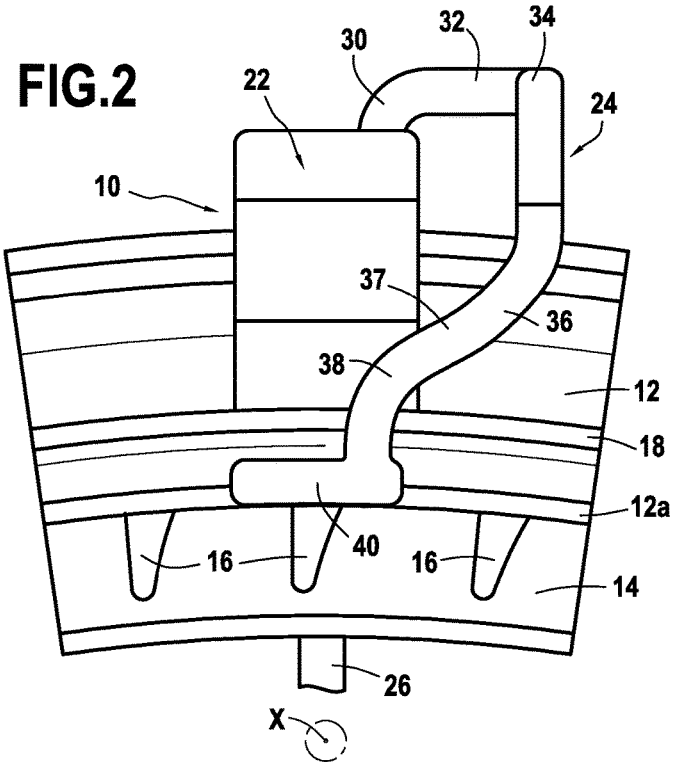
FIG. 2 is a diagrammatic face view, looking in direction II of FIG. 1, showing a guide vane sector pattern in this embodiment.
Figure 4:
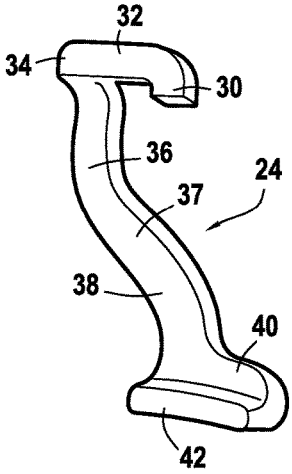
FIG. 4 is a perspective view of the FIG. 3 auxiliary duct pattern seen from a different angle.

FIGS. 1 to 6 show the implementation of a method of this type in the context of the present disclosure. More particularly, FIGS. 1 and 2 show a pattern 10 for a guide vane sector in an embodiment, which pattern is referred to below more simply as the "pattern 10" or as the "global pattern 10" for reasons of simplification. The pattern 10 seeks to reproduce the shape of a guide vane sector, specifically a sector of a nozzle for a low pressure turbine. For reasons of concision, the portions of the pattern 10 are given the same names below as the corresponding portions of the guide vane sector, even though these elements are different in practice.

The pattern 10 comprises a first platform 12 and a second platform 14. The first and second platforms are substantially in the shape of ring sectors and they are mutually coaxial. The axis of the pattern is the axis X about which the platforms 12 and 14 are coaxial. The axial direction corresponds to the direction of the axis X, and a radial direction is a direction perpendicular to the axis X and intersecting the axis X. Likewise, an axial plane is a plane containing the axis X and a radial plane is a plane perpendicular to the axis X. A circumference extends as a circle lying in a radial plane and centered on the axis X. A tangential or circumferential direction is a direction that is tangential to a circumference; it is perpendicular to the axis X but it does not cross the axis X. Unless specified to the contrary, the adjectives inner and outer are used relative to a radial direction such that the inner portion of an element is closer in a radial direction to the axis X than is an outer portion of the same element.

At least one airfoil 16 extends between the first and second platforms 12, 14. The airfoil 16 extends in a radial direction. In the present embodiment, and as can be seen in FIG. 2, three airfoils 16 extend between the first and second platforms. Nevertheless, the pattern 10 could have an arbitrary number of airfoils 16, including only one airfoil 16. The assembly formed by the airfoil 16 and the portions of the first and second platforms 12 and 14 adjacent to the airfoil 16 may sometimes be called guide vane. A plurality of guide vane sectors assembled one after another in a circumferential direction together form a 360° guide vane set.

The pattern 10 also has at least one fastener, and in this example two fasteners provided at opposite edges of the first platform 12, in particular a fastener 18 projecting from the first platform 12 towards a first edge 12*a* of the first pattern 12. The fastener 18 projects axially. Specifically, the first edge 12*a* is beside the leading edge of the airfoil 16. The fastener may project from an intermediate portion of the first platform 12. The fastener 18 may serve to fasten another vane stage. For mechanical reasons, the fastener 18 may be thicker in radial section than the first platform 12 beside the first edge 12*a*.

As can be seen in FIG. 1, in this embodiment, the fastener 18 projects from a side of the first platform 12 that is opposite from its side connected to the airfoil 16. The fastener 18 projects radially outwards. The fastener 18 may be in the form of a ring sector (see FIG. 2). The fastener 18 co-operates with the first platform 12 to form an annular rail beside the edge 12*a*, which rail in this example has a substantially V-shaped section.

As can be seen in FIG. 1, all or some of the characteristics described with reference to the fastener 18 may apply to the other fasteners.

Furthermore, the global pattern 10 includes at least one duct pattern that serves, when making the shell mold around the global pattern 10, to form a corresponding number of casting ducts for the metal. Specifically, as shown in FIG. 1, the global pattern 10 has a main casting duct pattern 20, at least one distribution duct pattern each connecting the main casting duct pattern 20 to a fastener, in particular a distribution duct pattern 22 connecting the main casting duct pattern 20 to the fastener 18, and an auxiliary duct pattern 24 connecting the main casting duct pattern 20 to the first platform 12 beside the edge 12*a*. Furthermore, the pattern 10 includes a discharge duct pattern 26.

In addition, a casting chamber pattern 28 is provided at the intersection between the main casting duct pattern 20, the distribution duct pattern 22, and the auxiliary duct pattern 24. The casting chamber pattern 28 is larger than the main casting duct pattern 20, particularly in an axial direction and/or in a circumferential direction. The roles of the various ducts and of the casting chamber are described in detail below.

The shape of the auxiliary duct pattern 24 is described with reference to FIGS. 1 to 4. In the present embodiment, the auxiliary duct pattern 24 is generally in the shape of a question mark, in particular when projected onto a radial plane, as can be seen in particular in FIGS. 2 and 3. More precisely, the auxiliary duct pattern 24 has a connection bend 30 for connecting it to the main casting duct pattern 20. The connection bend 30 projects from the main casting duct pattern 20 in a direction that is substantially opposite to the casting direction. Specifically, the connection bend 30 projects from the main casting duct pattern 20 in the opposite direction to the distribution duct pattern 22. Still more particularly, the connection bend 30 projects radially outwards. Such a direction is opposite to the casting direction that takes place mainly with a component that is radially inwards, and possibly axial in some locations. In this example, the connection bend 30 projects from the casting chamber pattern 28.

In the present embodiment, the auxiliary duct pattern 24 has a flow portion 32 seeking to space the auxiliary duct pattern 24 away from the casting chamber pattern 28 and away from the distribution duct pattern 22 in at least a first direction (see FIG. 2), specifically in a circumferential direction. Thus, in this embodiment, the flow portion 32 extends substantially in a circumferential direction. The auxiliary duct pattern comprises a bend portion 34 seeking to space the auxiliary duct pattern 24 away from the casting chamber pattern 28 and away from the distribution duct pattern 22 in at least a second direction (see FIG. 1), specifically in the axial direction X. Thus, in this embodiment, the bend portion 34 extends substantially in the axial direction X.

The auxiliary duct pattern 24 comprises a first curved portion 36 and a second curved portion 38. Each of said curved portions 36 and 38 is a portion of the auxiliary duct pattern 24 that is characterized by constant convexity. The first and second curved portions 36 and 38 are of opposite convexity and they meet at a point of inflection 37. Thus, the first and second curved portions form an undulation in the auxiliary duct pattern 24. In the present embodiment, the first and second curved portions 36 and 38 are situated substantially in the same plane, specifically a radial plane (see FIG. 1).

Figure 3:
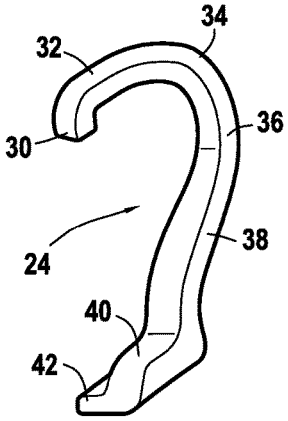
FIG. 3 is a perspective view of an auxiliary duct pattern.

Furthermore, at its junction with the first platform 12, the auxiliary duct pattern 24 includes an enlarged portion 40 and a junction portion 42. The enlarged portion 40 is enlarged relative to the second curved portion 38 in a circumferential direction. The junction portion 42 extends the enlarged portion 40 axially and/or circumferentially. As shown in FIG. 3, the junction portion 42 may taper radially relative to the enlarged portion 40.

In the present embodiment, the connection bend 30, the flow portion 32, the bend portion 34, the first curved portion 36, the second curved portion 38, the enlarged portion 40, and the junction portion 42 are connected to one another in that order within the auxiliary duct pattern 24. Nevertheless, the auxiliary duct pattern could omit at least one of these portions and/or could include them but with different shapes or in a different order, or could indeed include other portions.

Once the guide vane sector pattern 10 has been provided, it is possible to fabricate a shell mold around said pattern 10. A shell mold 100 may be formed by dipping the pattern 10 in a slurry, and then powdering or stuccoing the pattern 10 coated in slurry with refractory sand in order to form a shell around the pattern 10, and then baking the shell in order to solidify the slurry so as to consolidate the assembly. A plurality of successive dipping and dusting operations may be envisaged, e.g. about six, in order to obtain a shell of sufficient thickness prior to baking it, e.g. a shell having a thickness of five to ten millimeters. The shell thus has as many layers as the number of times the pair of dipping and powdering or stuccoing operations are performed. The term "refractory sand" is used in the present context to designate any granular material of grain size that is sufficiently small to satisfy the desired production tolerances, that is capable in the solid state of withstanding the temperatures of the molten metal, and that can be consolidated to form a single solid part by the slurry when baking the shell.

The slurry may comprise particles of refractory sand (typically ceramic particles) in suspension in a colloidal binder. Fabricating the shell mold comprises a succession of dipping the pattern cluster in said slurry and dusting and/or stuccoing the cluster after each dipping operation.

As mentioned above, while baking the shell mold, the pattern 10 is destroyed by the wax or the resin melting. For the above-described pattern 10, the shell mold 100 shown in FIG. 5 is obtained at the end of this baking operation.

Figure 5:
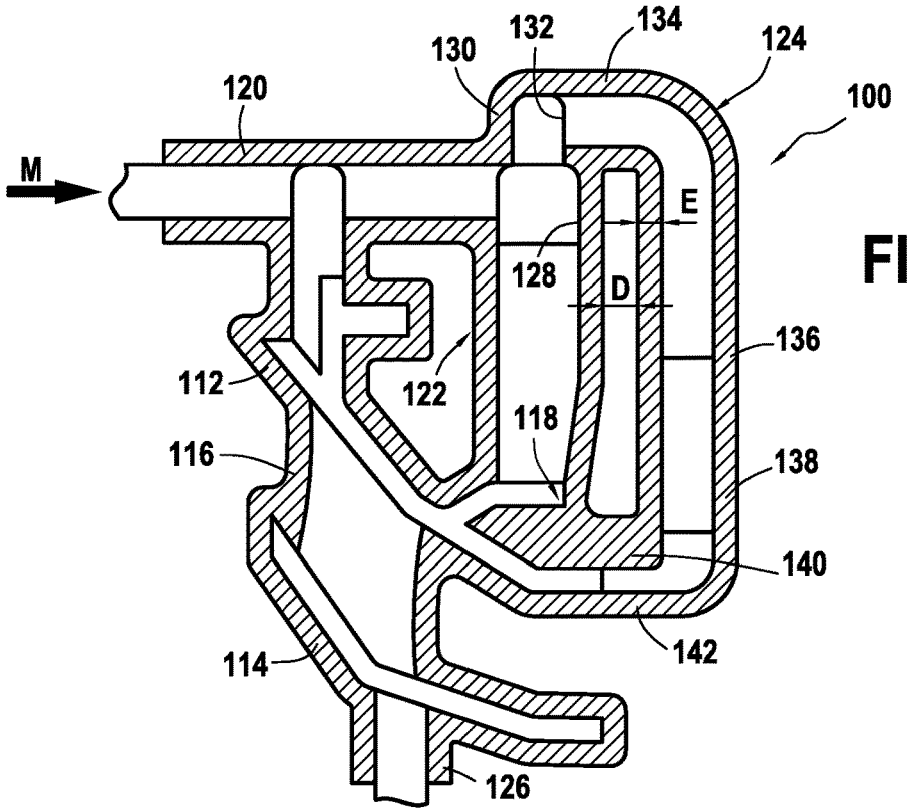
FIG. 5 is a diagrammatic section view of a shell mold for the FIG. 1 guide vane sector.

The shell mold 100 in FIG. 5 thus possesses the same characteristics as the above-described global pattern 10, but in the negative. Thus, the shell mold 100 forms a shell mold for a guide vane sector comprising a first platform and a second platform that are mutually coaxial and that have at least one airfoil extending between them. The shell mold 100 comprises a first platform mold portion 112 suitable for forming the first platform, a second platform mold portion 114 suitable for forming the second platform, an airfoil mold portion 116 suitable for forming the airfoil, a fastener mold portion 118 suitable for forming a fastener that projects from the first platform towards a first edge of the first platform, a main casting duct 120, a distribution duct 122 connecting the main casting duct 120 to the fastener mold portion 118, and an auxiliary duct 124 connecting the main casting duct 120 to the first platform mold portion 112 beside said edge.

The main casting duct 120 seeks to bring molten metal from a source, such as a pouring cup into which molten metal has been poured, to the molding portions 112, 114, 116, and 118 of the guide vane sector. Typically, the metal is cast in the direction of arrow M shown in FIG. 5 and thereafter follows the network of ducts and molding portions.

The distribution duct 122 and the auxiliary duct 124 distribute the molten metal from the main casting duct 120 to the various molding portions, i.e. respectively the fastener molding portion 118 and the first platform molding portion 112.

The auxiliary duct 124 is generally question-mark shaped, as is the auxiliary duct pattern 24, and it possesses portions 130-142 that correspond respectively to the portions 30-42 of the above-described auxiliary duct airfoil 24. For reasons of concision, these portions are given the same names, respectively.

Because of the fact that the connection bend 130 projects from the main casting duct 120 in a direction that is substantially opposite to the casting direction, which, in FIG. 5, is the gravity direction (or specifically radially inwards), the connection bend 130 acts as an overflow. Molten metal arriving via the main casting duct 120 does not engage in the connection bend 130 until it has filled all the other possible paths. Typically, in the example shown, the molten metal does not engage in the connection bend 130 until the casting chamber 128 has been filled. This makes it possible to control the sequence with which molten metal flows into the shell mold 100.

Because of the flow portion 132 and the bend portion 134, the auxiliary duct 124 is offset, specifically axially and/or circumferentially, relative to the distribution duct 122 and even to the casting chamber 128. Thus, the pattern 10 conserves good moldability in spite of the presence of the auxiliary duct 124. More precisely, in order to ensure uniform contact with the slurry and good drying of the slurry while fabricating the shell mold 100, and also in order to enhance cooling of the metal when casting, the pattern 10 is designed in such a manner that given the thickness of the wall of the shell mold 100, the auxiliary duct 124 is, at least for the most part, is separated from the distribution duct 122 by a distance D that is at least twice as great as the thickness E of a wall of the auxiliary duct 124. In other words, the following relationship applies: $D>2\times E$. The thicknesses D and E are shown in FIG. 5, in which this relationship is not satisfied because the thickness E is exaggerated for better understanding. As shown in this figure, the distance D is measured as the shortest length between the outside surfaces of the respective walls of the auxiliary duct 124 and of the distribution duct 122. The thickness E is the shortest length between the inside surface and the outside surface of a given wall. If the shell mold is obtained by dipping in a slurry as explained above, its walls are of substantially uniform thickness.

The undulation of the auxiliary duct formed by the first and second curved portions 136 and 138 flows the metal while it is moving down along the auxiliary duct. Thus, any turbulence that might lead to metallurgical defects is limited or even avoided. In general manner, and as can be seen FIG. 5 and FIGS. 3 and 4, the angles and changes in direction of the auxiliary duct 124 are rounded, so as to guide the metal without any impacts, with laminar flow of the metal serving to minimize metallurgical defects in the part.

The enlarged portion 140 is enlarged relative to the remainder of the auxiliary duct 124, in particular relative to the second curved portion 138, and it is enlarged in at least one direction, specifically the circumferential direction. This enables the molten metal to be better distributed for penetrating into the first platform molding portion 112. The junction portion 142 provides a regular transition between the enlarged portion 140 and the first platform molding portion 112 so as to guide the metal in laminar manner on entering into the first platform molding portion 112.

Figure 6:
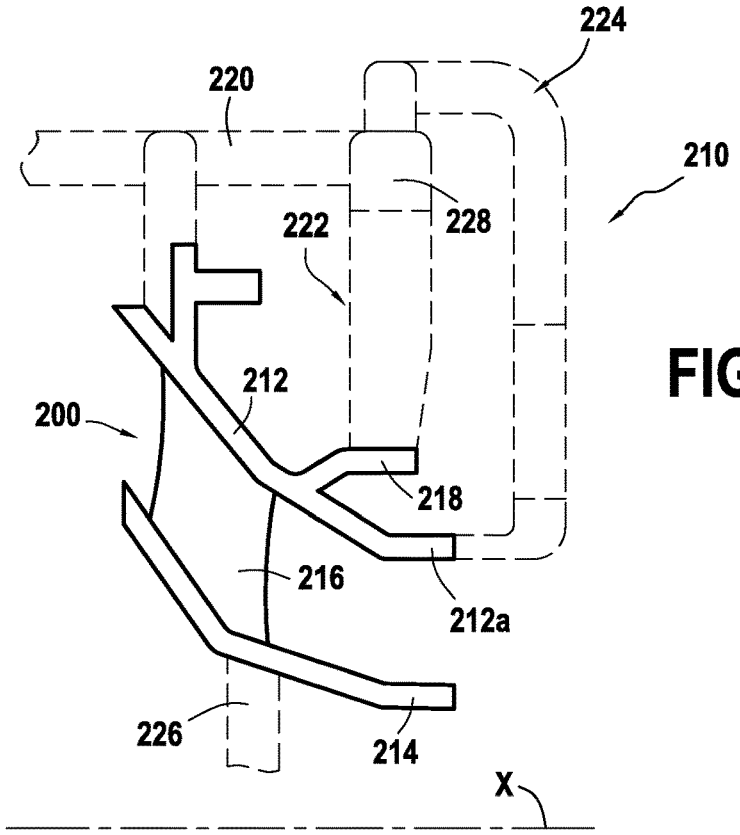
FIG. 6 is a diagrammatic side view in section of a guide vane sector made using the FIG. 5 shell mold.

FIG. 6 shows a part 210 obtained by casting using the shell mold 100 of FIG. 5. Once the metal has cooled, in directed or non-directed manner, the shell mold 100 is destroyed, e.g. by knocking out. The part 210 has a shape that corresponds to the shape of the pattern 10, possibly with dimensions that are slightly smaller as a result of the metal shrinking during cooling.

Like the pattern 10 and the mold 100, the part 210 comprises a guide vane sector 200 having a first platform 212 and a second platform 214 that are mutually coaxial about a common axis X, and between which there extends at least one airfoil 216, and a fastener 218 projecting from the first platform 212 towards a first edge 212*a* of the first platform. The part 210 also comprises arms 220, 222, 224, and 226 resulting from metal solidifying in the ducts 120, 122, 124, and 126 respectively, together with a weight 228 resulting from metal solidifying in the casting chamber 128.

Because the molten metal penetrates into the fastener molding portion 118 and into the first platform molding portion 112 via different ducts, as explained above, metallurgical defects are eliminated or moved out from the sector 200, i.e. away from the platforms 212, 214, the airfoil 216, and the fastener 218. For example, defects such as shrinkage can be offset into the arm 224 or the weight 228.

Finishing off the guide vane sector 200 may comprise steps such as removing the arms 220-226, the weight 228, and any other casting ducts, as shown by dashed lines in FIG. 6. The sector 200 may be subjected to finishing treatments that are themselves known.

Although the above-described embodiment is described in the context of a single mold for casting a single guide vane sector, in order to produce a plurality of sectors simultaneously, it is possible to unite a plurality of patterns in a single cluster in which they are connected together by a tree structure forming casting channels for the molten metal in the mold.

Although the present disclosure refers to specific embodiments, modifications may be made to those embodiments without going beyond the general ambit of the invention as defined by the claims. In particular, individual characteristics of the various embodiments shown and/or mentioned may be combined in additional embodiments. Consequently, the description and the drawings should be considered in a sense that is illustrative rather than restrictive.

We claim:

1. A shell mold for a guide vane sector comprising a first platform and a second platform that are mutually coaxial and between which there extends at least one airfoil, the shell mold having a first platform molding portion suitable for forming the first platform, a second platform molding portion suitable for forming the second platform, an airfoil molding portion suitable for forming the at least one airfoil, a fastener molding portion suitable for forming a fastener projecting from the first platform towards a first edge of the first platform, a main casting duct, a distribution duct connecting the main casting duct to the fastener molding portion, and an auxiliary duct connecting the main casting duct to the first platform molding portion beside said edge, wherein the auxiliary duct includes a connection bend for connection to the main casting duct, the connection bend projecting from the main casting duct in a direction opposite to a casting direction.

2. A shell mold according to claim 1, wherein the fastener projects from a side of the first platform that is opposite from its side connected to the at least one airfoil.

3. A shell mold according to claim 1, wherein the auxiliary duct is separated from the distribution duct by a distance that is not less than twice as great as a thickness of a wall of the auxiliary duct.

4. A shell mold according to claim 1, wherein the auxiliary duct includes at least one undulation.

5. A shell mold according to claim 1, wherein the auxiliary duct is in the shape of a question mark.

6. A shell mold according to claim 1, including a casting chamber at an intersection between the main casting duct, the distribution duct, and the auxiliary duct, the casting chamber being larger than the main casting duct.

7. A shell mold according to claim 1, wherein the auxiliary duct includes an enlarged portion at its junction with the first platform mold portion.

8. A method of fabricating a guide vane sector, comprising providing the shell mold according to claim 1 and casting metal into the shell mold.

9. A method of fabricating a shell mold, the method comprising providing a guide vane sector pattern comprising a first platform and a second platform that are mutually coaxial and between which there extends at least one airfoil, and a fastener projecting from the first platform towards a first edge of the first platform, the pattern further comprising a main casting duct pattern, a distribution duct pattern connecting the main casting duct pattern to the fastener, and an auxiliary duct pattern connecting the main casting duct pattern to the first platform beside said edge, the method further comprising making a shell around said pattern and destroying the pattern.

* * * * *